United States Patent [19]

Burger

[11] Patent Number: 4,799,664

[45] Date of Patent: Jan. 24, 1989

[54] SHEET FEEDER FOR SHEET-PROCESSING MACHINES

[75] Inventor: Karl H. Burger, Wiesbaden, Fed. Rep. of Germany

[73] Assignee: Neue Rotoprint GmbH, Berlin, Fed. Rep. of Germany

[21] Appl. No.: 16,574

[22] Filed: Feb. 19, 1987

[30] Foreign Application Priority Data

Feb. 20, 1986 [DE] Fed. Rep. of Germany ..... 3605534

[51] Int. Cl.[4] ..... B65H 5/02

[52] U.S. Cl. ..... 271/277; 271/204

[58] Field of Search ..... 271/277, 204, 205, 206

[56] References Cited

U.S. PATENT DOCUMENTS

| | | | |
|---|---|---|---|
| 1,462,923 | 7/1923 | Stevens | 271/204 |
| 3,266,796 | 8/1966 | Haney | 271/206 X |
| 4,203,590 | 5/1980 | Blessing | 271/204 X |
| 4,205,837 | 6/1980 | von Hein | 271/204 X |

FOREIGN PATENT DOCUMENTS

| | | | |
|---|---|---|---|
| 2724979 | 12/1978 | Fed. Rep. of Germany | 271/204 |

*Primary Examiner*—Richard A. Schacher

*Attorney, Agent, or Firm*—Cushman, Darby & Cushman

[57] ABSTRACT

A sheet feeder for sheet-processing machines having a positively driven, gripping mechanism which travels over at least two deflection wheels including at least one sheet-transporting gripper which is opened or closed during the course of travel through a revolving path. A number of toothed belts can be used; each belt includes a plurality of spaced aparet recesses into which a support body carrying a gripper mechanism is removably inserted. The deflection wheels are provided with circumferential recesses which correspond to an inwardly protruding part of the support body of the gripper mechanism in the form of an actuating lever that is actuated on striking or leaving a cam race, which may be part of the circumferential recesses of the deflection wheels.

12 Claims, 2 Drawing Sheets

FIG. 3
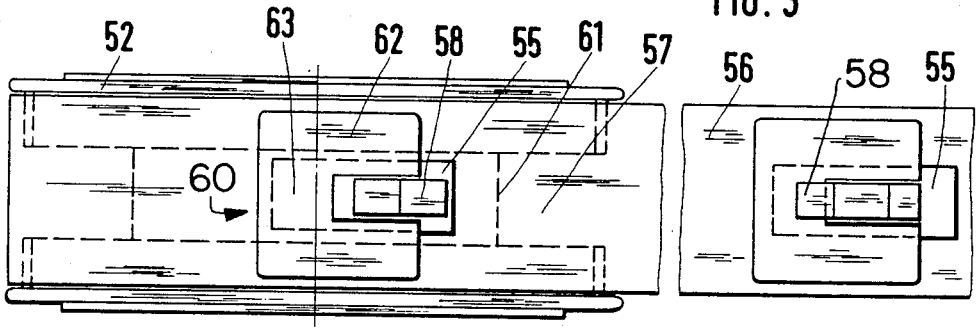
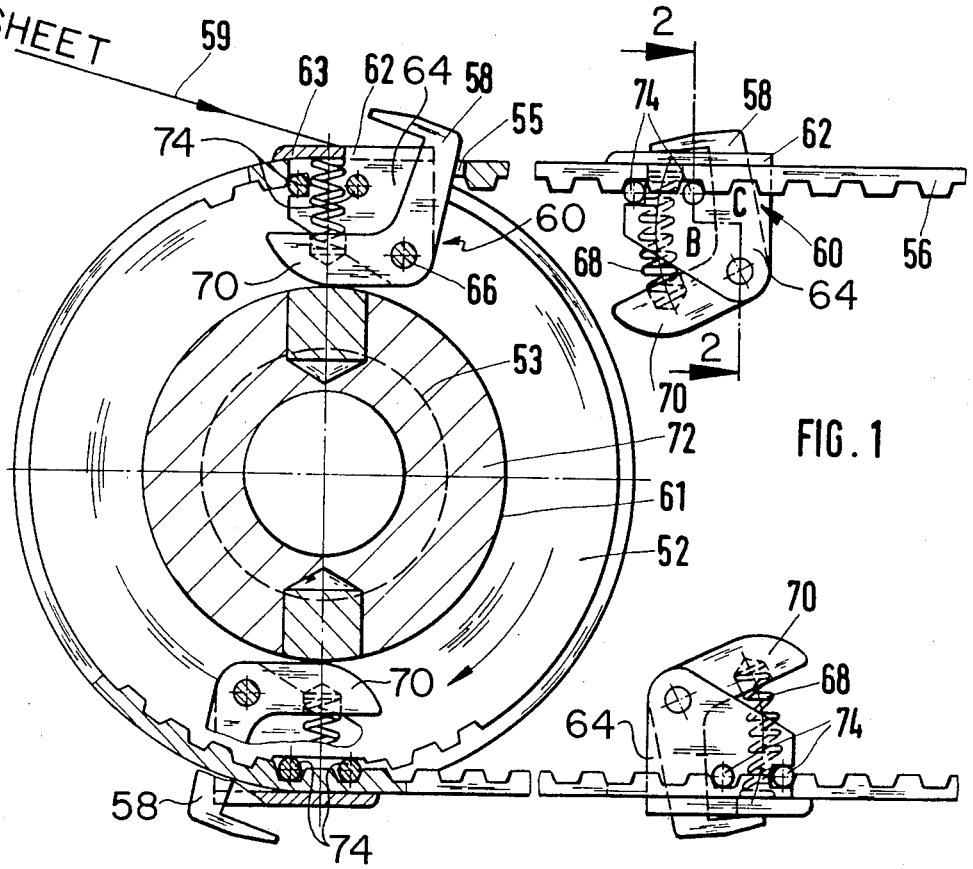
FIG. 1

SHEET FEEDER FOR SHEET-PROCESSING MACHINES

FIELD OF THE INVENTION

The present invention relates to a sheet feeder for sheet-processing machines, having a positively driven revolving advancement means. The advancement means travels over at least two deflection wheels located at its ends and optionally also over support wheels disposed in between, and on its top it has at least one sheet transporting gripper, which is opened or closed in the course of the revolving path.

BACKGROUND OF THE INVENTION

Sheet feeders of this type are known in various forms in the prior art. Typically, such arrangements are embodied as chain conveyors, which frequently advance a sheet to the front marker of a printing machine or the like. A disadvantage of such chain conveyors is that because of their construction, including chains, they are relatively complicated and thus cost-intensive. The grippers are often even incorporated into the chain on a separate component in the form of a gripper carriage, which again entails a not-inconsiderable expenditure for construction. Moreover, chain conveyors are always quite noisy in operation and their mass is considerable, so that from the outset they are either unusable or only conditionally usable in high-speed machines.

OBJECT AND SUMMARY OF THE INVENTION

It is accordingly the object of the present invention to improve the above-described sheet feeders for sheet-processing machines such that they are particularly lightweight and simple in construction and are thus usable for high-speed machines, yet the individual grippers can nevertheless be replaced without difficulty as needed.

This object is attained in accordance with the invention in that the revolving advancement means is embodied by a number of toothed belts traveling over correspondingly shaped gear wheels. A recess is provided at one or more points along the longitudinal extension of the belts, into which a support body carrying a gripper mechanism is removably. The gear wheels are provided with circumferential recesses which correspond to the inwardly protruding parts of the support body and gripper mechanism and each gripper mechanism has an actuation lever which is actuated upon striking or leaving a cam race. By embodying the sheet feeder in this way, the disadvantages of the prior art are overcome in a particularly simple manner. By applying the teaching of the invention, conventional toothed belts available in commerce can be equipped at arbitrary points with a gripper mechanism, which can be replaced without difficulty in the event of malfunctions. Particularly advantageously, the gripper mechanism of the sheet feeder is actuated by providing that the cam race for the actuating lever is part of the circumferential recesses of the gear wheel or wheels. This means that the revolving grippers are actuated particularly simply by striking or leaving one of the gear wheels, yet it is not precluded that a separate (stationary) cam race may be provided for this purpose, especially when opening and/or closing of the grippers is desired at some other point than in the vicinity of one of the support or deflection wheels of the sheet feeder.

The support body preferably passes through the toothed belt and rest with its support plate on the outside of the toothed belt, being firmly clamped by at least two securing pins that rest on the inside of the toothed belt and pass through the support body. With this kind of fastening, the gripper mechanism can be replaced quickly and easily.

The gripper mechanism has a hook-like gripper and in the clamping position this gripper rests on the support plate on the top of the toothed belt. Since the gripper is pivotable in the direction of the toothed belt about a shaft that is disposed spaced apart from the toothed belt on its inside, ahead of the clamping point in the direction of advancement of the toothed belt. Upon opening the gripper moves relative to the toothed belt in the direction of revolution thereof, and upon closing the gripper moves in the opposite direction. Accordingly, even a sheet that has been advanced at the speed of the toothed belt can be grasped without difficulty.

An exemplary embodiment of the present invention is described below, referring to the accompanying drawings.

BRIEF DESCRIPTION OF THE DRAWINGS

FIG. 1 shows the structural embodiment of one end of a conveyor-belt-like sheet feeder according to the present invention, the opposite end being embodied substantially mirror-symmetrically to it;

FIG. 3 is a plan view on FIG. 1; and

DESCRIPTION OF THE PREFERRED EMBODIMENT

Figure 4:
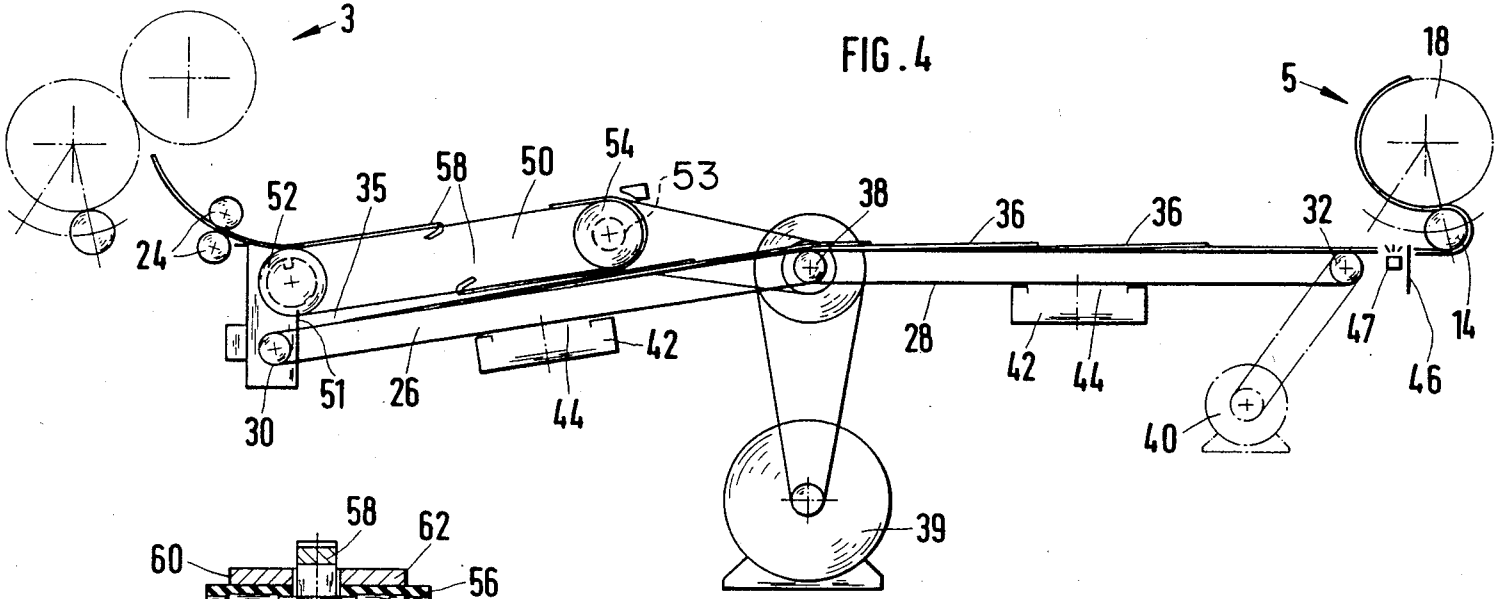
FIG. 4 is a basic illustration of a sheet feeder and inverter apparatus for offset printing machines arranged in tandem, in which the sheet feeder according to the invention and shown in FIGS. 1–3 is used as the inverter apparatus 50.

In the preferred exemplary embodiment of a sheet feeder described below, two toothed belts 56 disposed beside one another parallel to the plane of the drawing are fastened about two deflection rollers or gear wheels 52/54. Only each one deflection roller 52 is shown in FIG. 1, along with part of the toothed belt 56.

Figure 2:
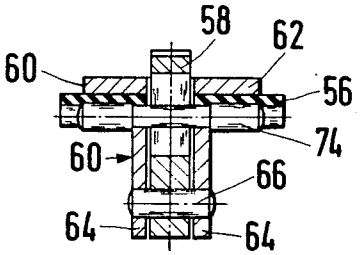
FIG. 2 is a section taken along the line A–D of FIG. 1.

As shown in FIG. 1, the belts 56 are embodied as toothed belts, and the associated deflection rollers 52/54 are embodied as corresponding gear wheels. However, other forms of belts and deflection rollers are also possible. As FIGS. 1, 2 and 3 show, the toothed belt 56 has a centrally disposed recess 55 at certain points along its longitudinal extension, into which recess the support body 60, which includes the gripper mechanism of the gripper 58, can be removably inserted. The support body 60 has an approximately T-shaped profile provided with a central recess, and includes a support plate 62, which is disposed on the top of the toothed belt 56, and two middle parts 64 extending at right angles to the support plate 62. Gripper 58 is positioned between parts 64 and is pivotally supported therebetween by a hinge pin 66 positioned some distance away from the support plate 62 or from the toothed belt 56. The hook-like gripper 58 is, accordingly, pivotable about the hinge pin 66, and in the gripping position the hook-like part end of the gripper that protrudes upward past the support plate 62 and past the top of the toothed belt 56 rests on the uniterrupted part 63 of the support plate 62. A compression spring 68 is fastened between the support plate 62, 63 and a cam-lever-like extension 70 of the hook-like gripper 58. By means of this compression spring 68, the gripper 58 is normally pivoted into its clamping or gripping position as shown in the upper and lower right portion of FIG. 1. The gripper assumes this clamped condition for the entire course of the upper and lower run of the deflection apparatus and also while passing around the deflection roller 54. Only when the gripper mechanism is passing around the deflection roller or gear wheel 52 does the gripper assume the open position, as shown at the upper and lower left portion in FIG. 1. When the gripper mechanism passes around roller 52 the cam-like extension 70 strikes the middle part 72 the outer surface of which forms a cam race 61, which has a greater diameter than the deflection roller 54. This means that both the deflection roller 54 and the deflection roller 52 have a groove-like recess 57, as shown in FIG. 3, in their central planes, which is approximately equivalent to the width of the lower part of the gripper mechanism (see FIG. 2); however, the groove-like recess in the deflection roller 52 is not as deep as in the deflection roller 54, so that the gripper mechanism does not open at the deflection roller 54. The depth of the recess in the deflection roller 54 is indicated by a broken line in FIG. 1 at 53 and is also indicated by a broken line 53 in FIG. 4.

The gripper mechanism is advantageously secured on the toothed belt 56, by means of two securing pins 74 passes therethrough, in such a way that it can be readily released. After these securing pins 74 are removed the gripper mechanism in FIG. 5 can be simply lifted upward out of the recess in the toothed belt 56. For better locking on the middle parts 64 of the T-shaped support body 60, these pins 74 are provided in the middle with a section of reduced diameter, as FIG. 2 clearly shows.

The securing pins 74 are preferably disposed such that, as shown in FIG. 1, they fill exactly two adjacent indentations of the toothed belt. Accordingly, the teeth must then be omitted at the corresponding points of the gear wheels 52, 54, as indicated in the lower left portion of FIG. 1. This kind of arrangement of the securing pins then also dictates that the grippers on the toothed belt 54 be spaced apart by a distance that corresponds exactly to the diameter of the pitch circle of the gear wheels 52, 54, or an integral multiple thereof. However, it is conceiveable for these securing pins 74 to have a cross section that is exactly equivalent to one elevation or one tooth of the toothed belt and for the securing pins then to be disposed precisely in place of such a tooth. In that case, the position of the grippers on the toothed belt can be selected virtually freely.

In the upper left of FIG. 1, a gripper mechanism is shown that is just beginning to leave the deflection roller 52 and thus is initiating the process of closing the gripper 58. At the same point, the path of a printed sheet that is emerging from the first printing machine 3 is represented by an arrow 59. The printed sheet meets the plate 62/63 at an acute angle on the upper run of the toothed belt 56. As a result, any waviness on the front edge of the printed sheet can be compensated for, since the sheet thus aligns itself on the plate 62/63. Since the speed of the toothed belt 56 and the operating speed of the printing machine are adapted to one another, the sheet that is to be gripped is fed to the toothed belt 56 or to the support plate 62, 63 at a speed such that the differential speed is zero, or virtually zero. As viewed in FIG. 1 in the direction of movement of the toothed belt 56 the hinge pin 66 is located in front of and below the point at which the sheet meets the support plate 62, 63. Consequently, the hook-like upper end of the gripper 58 that protrudes upward past the toothed belt 56 moves backward relative to the toothed belt 56 as it closes, or in other words contrary to the direction of movement of the toothed belt. This assures secure clamping of the front edge of the printed sheet arriving from the first printing machine.

FIG. 4 is a basic illustration of a specific application of the sheet feeder according to the invention, in the form of an inverter apparatus 50 of a sheet feeder and inverter apparatus between two printing machines 3, 5 connected in series with one another in a tandem arrangement; all that is shown of these machines, in dot-dash lines, are one or two pressure rollers and a suction roller that shuttles back and forth for receiving and introducing a sheet that is to be printed.

In the area below and behind the pair of delivery rollers 24 of the first printing machine - as viewed in the direction of movement of the printed sheets - is an elongated belt conveyor 26, which comprises a number of endless elastic belts 28 disposed parallel to one another (as well as to the plane of the drawing) and having high coefficients of friction. These belts 28 are guided over two deflection rollers 30 and 32 at the beginning and end of the elongated belt conveyor 26, and as needed additional support rollers 34 are distributed over the length of this conveyor. One support and drive roller is shown in the middle at 38. The conveyor embodied in this manner functions quite similarly to a conventional conveyor belt; that is, the printed sheets 36 deposited by the inverter apparatus 50 on its top and overlapping one another to a variable extent as needed are conveyed from the first printing machine (on the left) to the second printing machine (on the right), at a speed that depends on the circumstances of a particular situation and which will be discussed at greater length below. The conveyor need not comprise individual endless belts 28 (of approximately circular cross section) disposed parallel to one another; instead, it is quite conceivable to use one coherent wide belt, for example, one with large holes or having a mesh-like structure. Naturally, an essential factor here is that the individual belts be operated at the same speed. The drive of the belt conveyor 26 can be effected either centrally, with the middle support and drive roller 38, via the main motor 39, which at the same time also drives the two printing machines 3, 5 synchronously, or alternatively—and as shown—by means of a separate regulatable drive motor 40. For example drive motor 40 acts upon the deflection roller 32 at the end of the conveyor 26 and drives only the belt conveyor 26, while the main motor 39 drives the inverter apparatus 50 and the two printing machines 3, 5.

To assure that the printed sheets deposited loosely on the top of the conveyor will be compulsorily moved forward, a plurality of large suction chambers 42 are disposed directly beneath the belt conveyor 26 and are subjected to a vacuum via suitable means. These suction chambers 42 have openings 44 pointing toward the top, that is, in the direction of the conveyor 26, resulting in a considerable flow of air toward the suction chambers; via the large surface area of each printed sheet 36 deposited on the conveyor, the result is a more than adequate pressing force that presses the printed sheets against the conveyor, or its belts 28, which have a high coefficient of friction. Thus the printed sheets are fixed on the conveyor belt or on the belts of the conveyor and are compulsorily moved toward the second printing machine, where the front edge of each printed sheet finally strikes against a stop 46 serving as a front marker of the second printing machine. In the course of the conveyor and preferably at its end, the printed sheets are also made flush at the sides, if this is at all necessary. In the vicinity of the aforementioned stop 46 on the second printing machine, that is, at its front marker, the fed sheets are delivered to the counter-pressure cylinder 18 of the second printing machine in a known manner by a suction roller 14 that shuttles back and forth.

In the vicinity of the aforementioned stop 46 (front marker of the second printing machine), a monitoring device is provided, for instance in the form of a reflex head 47. On the one hand, this device monitors the correct timing and spacing of the entry of the sheets to the machine 5, and on the other hand, it controls the switching on of the offset cylinder 20 of the machine 5 whenever a sheet is present at the instant an inquiry is made.

As shown in FIG. 4, the printed sheet emerging from the first printing machine 3 is just being guided to the beginning of the first run of the inverter apparatus 50, in such a manner that the front edge of the printed sheet is fed under the gripper 58 of the inverter apparatus that is closing at this point. The inverter apparatus operates at a circumferential speed that is exactly equivalent to the delivery speed of the printed sheet from the first printing machine 3, so that the entire sheet is drawn from the first printing machine and wrapped around the deflection roller 54 of the inverter apparatus—without the gripper 58 coming open during this process. As a result, the top side of the sheet emerging from the printing machine is inverted to face downward, since the printed side of the printed sheet, after reaching the lower run of the inverter apparatus points downward or in other words toward the conveyor 26. As soon as the gripper 58 secured to the toothed belt 56 of the inverter apparatus meets the deflection roller 42 at the end of the lower run (that is, the end in the circumferential direction of the belt), this gripper opens and releases the front edge of the printed sheet, which now has the previously produced printed image on its lower side, that is, the side facing the conveyor 26. The front edge of the thus-released, inverted printed sheet then strikes a stop 51, at the end of the gap formed by the upper run of the belt conveyor 26 and the lower run of the inverter apparatus 50. As a result, the printed sheet is stopped, and the suction generated by the suction chambers 42 draws it against the belt conveyor 26.

I claim:

1. A sheet feeder for sheet-processing machines, having a positively driven, belt means defining an endless revolving path of travel which travels over at least two wheels located at the opposite ends of the path of travel, said belt means has on the top thereof at least one sheet-transporting gripper which is opened or closed in the course of the revolving path, characterized in that said belt means includes a recess provided at one or more points along the longitudinal extension of said belt means into which recess a support body carrying a gripper mechanism is removably inserted;

each gripper mechanism including an actuating lever depending below said belt means, at least one of said wheels being provided with means defining a circumferential recess having a depth corresponding to the depending portion of said actuating lever which is actuated upon striking or leaving the surface defined by said circumferential recess means, wherein said support body includes a support plate which rests on the outside of said belt means, said support body passing through said belt means and being firmly clamped by means of at least two securing pins that rest on the inside of said belt means and which pass through said support body.

2. A sheet feeder as in claim 1 characterized in that the gripper mechanism has a hook-like gripper, which in the clamping position rests on the support plate on the top of the toothed belt.

3. A sheet feeder as in claim 2, characterized in that the hook-like gripper is pivotable in the direction of said belt means about a shaft which is disposed spaced apart from said belt means on its inside ahead of the clamping point in the direction of advancement of said belt means.

4. A sheet feeder as in claim 3, characterized in that the hook-like gripper has a cam-lever-like extension protruding inwardly from said shaft, which extension is provided for engagement with the cam race.

5. A sheet feeder as in claim 1, characterized in that the hook-like gripper is urged into the clamping position by a spring.

6. A sheet feeder for use with sheet-processing machines comprising a conveyor formed from a plurality of belts having a flat exterior surface and a toothed interior surface and at least two spaced apart wheels positioned at opposite ends of an endless path, said belts including means defining a plurality of recesses extending therethrough, each of a plurality of sheet gripper mechanisms being removably positioned in one of said plurality of recesses, said gripper mechanisms comprising a body portion including a horizontally extending plate and a support assembly depending therefrom so that when positioned in said recess said support assembly passes through said recess and said horizontal plate rests on the exterior surface of said belt, securing means engaging both the toothed interior surface and said support assembly for removably securing said gripping mechanism to said belt, said horizontal plate including means defining a slot shaped opening therein, a gripping portion pivotally attached to said support assembly, said gripping portion including an exterior gripping finger positioned within said slot opening and a lower actuating finger extending downwardly below said support assembly, and spring means operatively connected between said horizontal plate and said lower actuating finger to maintain said gripping mechanism in a normally closed position with said upper gripping finger engaging said horizontal plate.

7. A sheet feeder as in claim 6 further including gripper mechanism opening means positioned at least at one end of said endless path for opening said gripper mechanism.

8. A sheet feeder as in claim 7 wherein said opening means comprises a cam race for intersecting said lower actuating finger and pivoting said gripping portion into an open position so that said upper gripping finger is pivoted in the direction of belt travel and upwardly away from said horizontal plate.

9. A sheet feeder as in claim 8 wherein said cam race is comprised of a circumferential recess formed in at least one of said wheels.

10. A sheet feeder as in claim 6 wherein said securing means includes at least two pins that extend through said support assembly and engage the interior of said belt.

11. A sheet feeder as in claim 6 wherein said gripping mechanism has essentially a C shape that faces in a rearward direction.

12. A sheet feeder as in claim 6 wherein the pivotal connection between said gripper mechanism and said support assembly is spaced below said belt and ahead of the clamping point, defined between said gripping finger and horizontal plate, in the direction of travel of said belt.

* * * * *